United States Patent [19]

Bailey

[11] 4,108,130

[45] Aug. 22, 1978

[54] FUEL INJECTION PUMP

[75] Inventor: John M. Bailey, Dunlap, Ill.

[73] Assignee: Caterpillar Tractor Co., Peoria, Ill.

[21] Appl. No.: 798,053

[22] Filed: May 18, 1977

[51] Int. Cl.[2] ..... F02M 41/06

[52] U.S. Cl. ..... 123/139 AQ; 123/139 BC; 123/139 AL; 417/294; 417/462

[58] Field of Search ..... 123/139 AP, 139 BC, 123/139 BD, 139 AQ, 139 AL, 140 FG; 417/294, 462

[56] References Cited

U.S. PATENT DOCUMENTS

| | | | |
|---|---|---|---|
| 2,743,594 | 5/1956 | Hill et al. | 123/139 AQ |
| 3,091,231 | 5/1963 | Giraudon | 123/139 BC |
| 3,138,112 | 6/1964 | Porta et al. | 417/294 |
| 3,181,520 | 5/1965 | Mock | 123/139 AL |
| 3,319,568 | 5/1967 | Repko et al. | 123/140 FG |
| 3,771,506 | 11/1973 | Davis | 123/139 AQ |

*Primary Examiner*—Charles J. Myhre
*Assistant Examiner*—Andrew M. Dolinar
*Attorney, Agent, or Firm*—Phillips, Moore, Weissenberger, Lempio & Strabala

[57] ABSTRACT

A rotary distributor fuel pump for a multi-cylinder internal combustion engine is provided with a rotor to meter and distribute fuel to the engine cylinders. The rotor axially reciprocates to vary fuel quantity and can be advanced or retarded relative the housing to provide timing through angular displacement of a ring gear which forms part of a planetary gear assembly driving the rotor. Fuel is pressurized by pistons mounted in the stationary housing and reciprocated radially in relation to the rotor under urging of a second rotating member having an eccentric inner bore. Axial displacement of the rotor is accomplished through conventional governor means.

14 Claims, 7 Drawing Figures

FUEL INJECTION PUMP

BACKGROUND OF THE INVENTION

This invention relates to a distributor type fuel injection pump having in one embodiment opposed reciprocating plungers mounted in a housing to provide pressurized fluid to a rotor which in turn provides fuel metering, distribution, and timing of the fuel delivery to an internal combustion engine.

This invention is particularly directed toward a distributor fuel injection pump which is capable of a high fueling capacity in a small overall size for use on large internal combustion engines particularly the compression ignition type engines. Previus pumps utilized on large engines such as this have required separate injection pumps for each cylinder or a very large distributor pump. Although this pump is designed with a high capacity for large engines, it is easily adaptable to smaller engines by changing the porting structure and internal passage size without a major design of the fuel pump.

Fuel pumps in the past of the types described have utilized reciprocating plungers but have had rather complex camming surfaces. Such complex camming surfaces and cam slippers have limited the quantity and pressure of fuel injected because of excessive cam stress. This has tended to restrict the use of distributor pumps to relatively small engines.

Particular problems associated with all fuel injection pumps of the type described herein include a requirement for a relatively high pressure to be communicated to the engine cylinder for ignition therein by compression. Fuel must be communicated to the engine cylinder at a particular time in order to achieve optimum performance of the engine. Fuel also must be delivered to the engine in correct quantity as dictated by the power required to maintain a desired operating speed. Amounts of fuel communicated to the engine obviously must vary according the engine load. Thus, a distributor type fuel injection pump must serve initially to pressurize the fuel, and secondly to meter the fuel as required. It is also appropriate to vary the injection timing in proportion to engine speed.

SUMMARY OF THE INVENTION

The present invention is directed to overcoming one or more of the problems as set forth above.

Broadly stated, the invention is a distributor type fuel pump for an engine having a plurality of cylinders. The fuel pump is comprised of a housing having a generally hollow cylindrical first portion and a second portion affixed to the first portion to form a substantially closed cavity. The second portion defines a plurality of ports adapted for connection to the plurality of engine cylinders. A first rotating assembly is journalled in the cavity and defines an eccentric inner bore proximate the second portion. The first rotating assembly also includes an integrally formed shaft extending outwardly of the cavity and distal of the second portion. A second rotating assembly is journaled for rotation in the second portion and extends inwardly of the eccentric bore. Planetary gear means including a ring gear fixedly associated with the housing drivingly connects the first rotating assembly with the second rotating assembly to cause the second rotating assembly to rotate at a predetermined speed proportional to the speed of rotation of the first rotating assembly. The fuel pump is also provided with governor means associated with the second rotating assembly and rotatable therewith to cause axial movement in the cavity of the second rotating assembly. The fuel pump is also provided with means responsive to the engine speed for rotating the ring gear relative to the housing. The fuel pump also includes a fuel pressurization means for pressurizing and communicating pressurized fluid communicated to the fuel pump to the interior of the cavity.

A predetermined number of radially oriented pistons are located in cylinders formed in the second portion. Pistons are mounted for reciprocation therein and each has a slipper adapted to engage the eccentric inner bore of the first rotating assembly. Resilient means urge the pistons radially outwardly. The pistons increase pressure of fluid communicated thereto. The second rotating assembly also includes a first passage system for periodically communicating an amount of pressurized fluid from the interior cavity to the inner end of the pumping cylinders in the second portion. The amount of pressurized fluid communicated to each cylinder is proportional to the axial position of the second rotating assembly. The second rotating assembly also defines passages angularly displaced from the first passages a predetermined amount for receiving the amount of pressurized fluid at a relatively higher pressure from the piston means and at a rotative position of the shaft determined by the means responsive to engine speed. The second passage means communicates the amount of higher pressurized fluid to one of the plurality of ports adapted for connection to the plurality of engine cylinders.

Other advantages and objectives of this invention will become apparent from a study of the accompanying drawings and following text.

DETAILED DESCRIPTION OF THE PREFERRED EMBODIMENT

Figure 1:
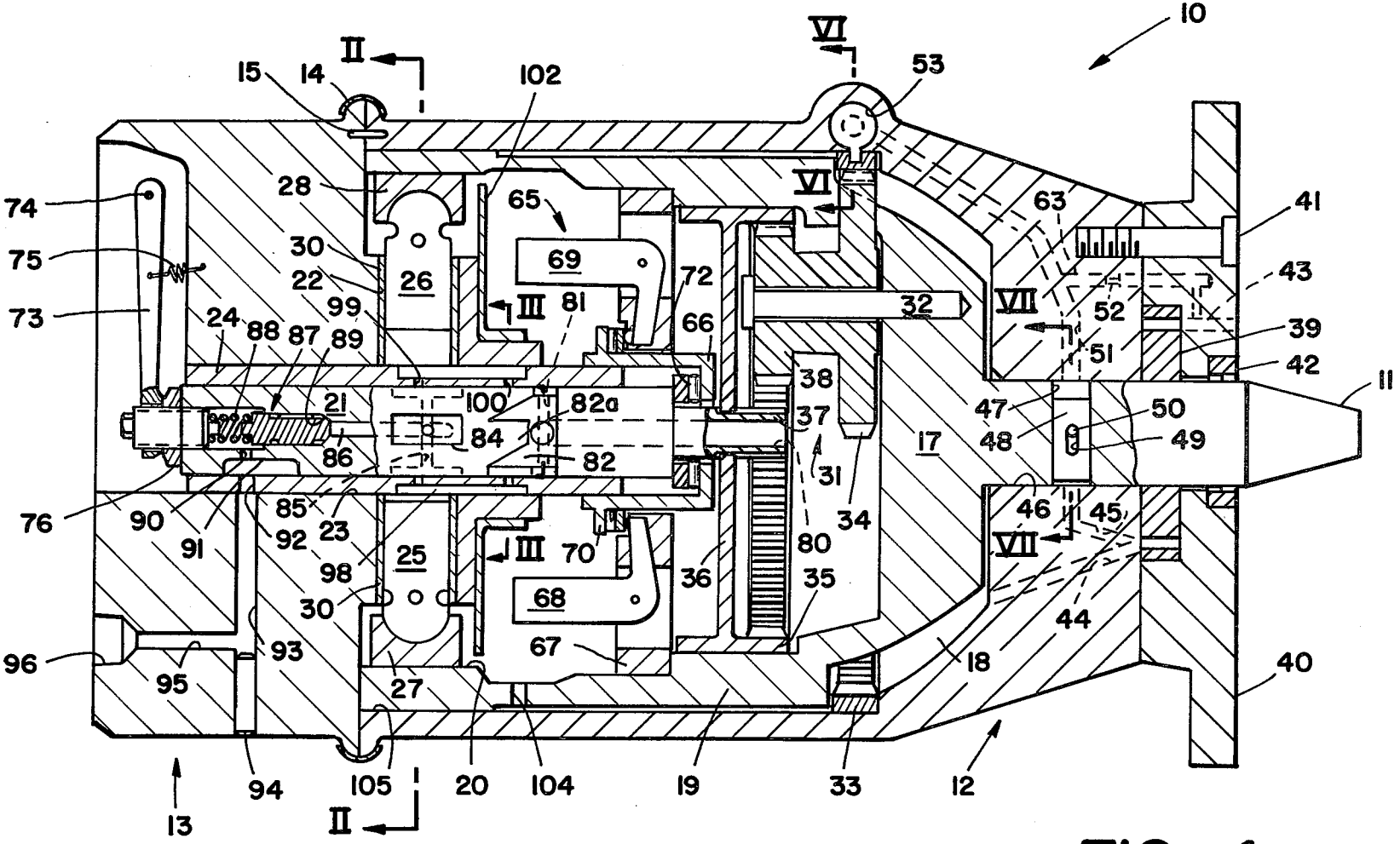
FIG. 1 is an elevation view in section of the distributor type fuel pump which incorporates the inventive concept.

Referring to FIG. 1, an engine fuel pump 10 is shown partly in section. Engine fuel pump 10 is capable of being driven through a shaft 11, extending outwardly of the fuel pump housing which is comprised of a first portion 12 and a second portion 13 affixed to the first portion 12 by means well known in the art, such as a clamp 14. Aligning pins 15 (only one of which is shown in FIG. 1) may be used to ensure alignment of the second portion 13 with first portion 12 upon assembly.

Shaft 11 forms a portion of a first rotating assembly 17 which is journaled in an interior cavity 18 of the first portion 12. First rotating assembly 17 defines a cylindrical extension 19 which in its outer extremity defines an eccentric inner bore 20 the purpose of which will become apparent in the following discussion.

Journalled in the second portion 13 is a second rotating assembly in the form of a metering rotor 21. Metering rotor 21 extends inwardly of cavity 18 and eccentric bore 20. Interposed between metering rotor 21 and eccentric bore 20 is an extension of second portion 13 defining a transverse bore 22 which intercepts an axial bore 23 in second portion 13. Axial bore 23 has fitted therein a sleeve member 24 in which metering rotor 21 is both rotatably and reciprocally movable. Transverse bore 22 is fitted with liners 30 reciprocally mounting opposed piston members 25 and 26 each of which are fitted into a slipper 27 and 28 respectively. Resilient means which may be in the form of a C-shaped spring 29 (see FIG. 2) is formed to engage piston members 25 and 26 adjacent the slippers 27 and 28 to urge piston members 25 and 26 outwardly in transverse bore 22 so that slippers 27 and 28 engage the eccentric bore 20. Therefore, upon rotation of eccentric bore 20, piston members 25 and 26 are reciprocated in bore 22.

Metering rotor 21 is driven by an epicyclic gear train which in turn is driven by shaft 11 of first portion 17. The epicyclic gear train driving metering rotor 21 is comprised of a cluster of planet gears 31 (one cluster is shown in FIG. 1) Cluster 31 is driven by a carrier pin 32 extending outwardly of first rotating assembly 17 into the cylindrical inner portion thereof. A ring gear 33 is fixedly associated with first portion 12 and is engagement with each gear 34 of planet gear clusters 31. A second ring gear 35 which serves as the sun gear is formed with a flange 36 splined to an extension 37 of metering rotor 21. A second gear 38 of planet gear cluster 31 is in driving engagement with ring gear 35. The gearing ratio between shaft 11 and metering rotor 21 may be adapted so that metering rotor 21 rotates at one-fourth the speed of rotation of shaft 11. Shaft 11 may be rotated at twice normal engine speed thus metering rotor 21 will operate at one-half engine speed.

The engine fuel pump 10 is provided with a fuel pressurization means in the form of a conventional gear pump 39 driven by shaft 11. Gear pump 39 is positioned in a flange 40 which is affixed to first portion 12 by conventional means such as bolt 41 (one of which is shown in FIG. 1). Flange 40 is adapted to be received on a conventional mounting pad on the associated internal combustion engine. Flange 40 is also fitted with a seal 42 of a conventional type well known in the art to prevent fuel leakage from the pump 39. Passage means such as passage 43 are formed in flange 40 to communicate fluid to gear pump 39 from a fluid source such as a fuel tank (not shown).

Figure 7:
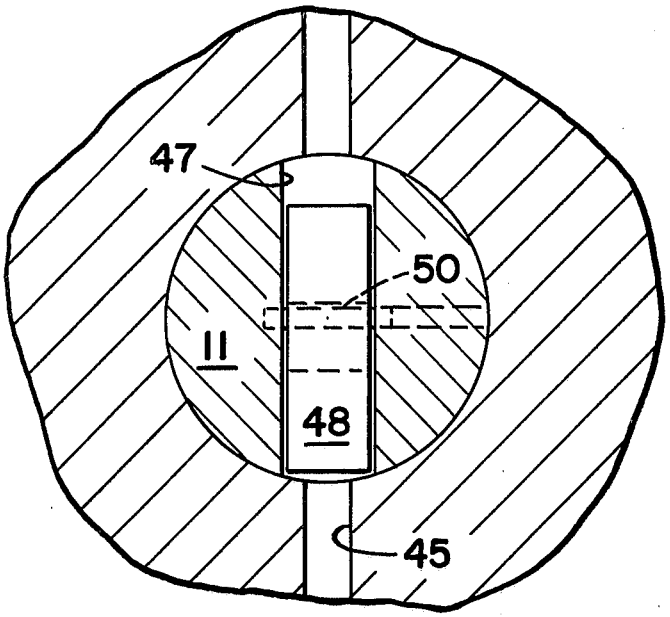
FIG. 7 is a portion of the fuel pump depicted in FIG. 1 showing the shuttle piston taken at lines VII—VII.

First portion 12 defines therein an internal passage 44 extending from gear pump 39 to the interior cavity 18. Thus, fluid pressurized by gear pump 39 is communicated through passage 44 to interior cavity 18 wherein a pressure is maintained equivalent to the output pressure controlled by a relief valve (not shown) of gear pump 39. A branching passage 45 communicates with passage 44 to communicate pressurized fluid to a bore 46 formed in first portion 12 through which shaft 11 extends and is journalled. Bore 46 forms an appropriate bearing surface for shaft 11. Shaft 11 is formed with a transverse bore 47 forming a cylinder. Mounted in transverse bore 47 is a shuttle piston 48. Referring to FIG. 7 in conjunction with FIG. 1 it can be seen that shuttle piston 48 is formed with a slot 49 through which a pin 50 extends. Slot 49 is formed to allow shuttle piston 48 to reciprocate a predetermined amount in the transverse bore 47.

Figure 6:
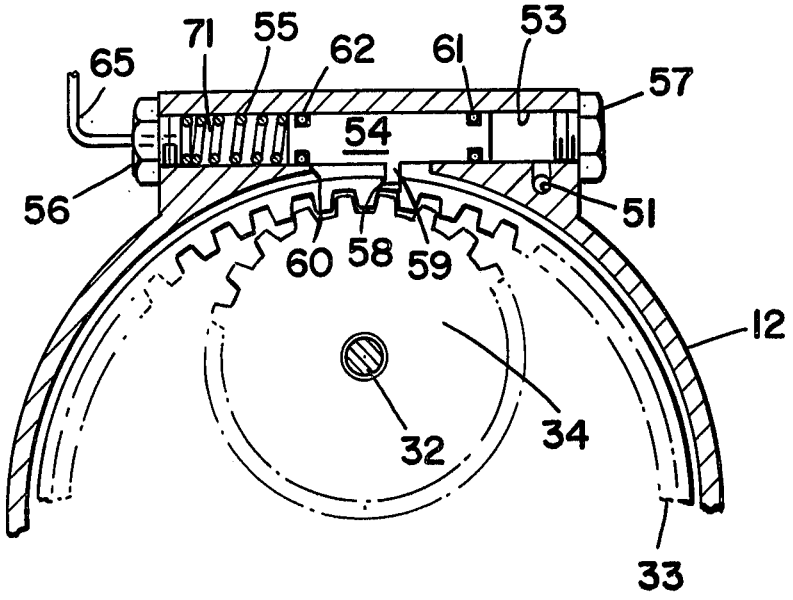
FIG. 6 is a portion of the fuel pump depicted in FIG. 1 taken at section line VI—VI, depicting the timing advance portion.

Also communicating with bore 46 and on the diametrically opposite side of bore 46 from passage 45 is a second passage 51 defined in first portion 12 and which communicates with a transverse bore 53 generally parallel to the plane of ring gear 33 and formed in first portion 12 in the vicinity of ring gear 33 (see FIG. 6). A branch passage 63 containing a restrictive orifice 52 from passage 51 directs fuel oil back to gear pump 39 inlet. Bore 53 has mounted for reciprocation therein a piston 54 reciprocally biased toward the one end of bore 53 which communicates with passage 51. The Resilient biasing may be accomplished by an helical spring 55 retained in bore 53 and by the cover member 56. A vent passage 65 is provided from spring cavity 71 to transfer pump inlet to prevent a pressure block behind piston 54. For completeness sake, the other opposite end of bore 53 adjacent passage 51 may similarly be closed by a cover member 57. Other appropriate sealing means may be effectively utilized. Ring gear 33 which is of a conventional type, also includes on its outer perimeter thereof a socket 58 formed to receive a tang 59 integrally formed with piston 54. Bore 53 is purposely opened at 60 to allow tang 59 to extend downwardly and engage socket 58 as seen in FIG. 6. With the opening 60 formed in housing 12, it may be necessary to include appropriate seal means such seal rings 61 and 62 to seal piston 54 in bore 53. The specific purpose of piston 54 will become apparent in the discussion of the operation of the fuel pump, suffice it to say at this time the purpose of piston 54 is to vary the relative position between the first rotating assembly 17 and the metering rotor 21.

Shaft 11 attached to flyweight carrier 67 drives a governor 65 which serves to move metering rotor 21 axially as shown in FIG. 1 in response to changes in engine speed as a result of change in engine load or in response to changes in throttle positions. A flyweight carrier 67 is fixed and driven by rotating assembly 17 and has mounted therein governor flyweights such as flyweights 68 and 69 formed in the usual manner. Weights 68 and 69 engage a flange assembly 70 formed in part by cup shaped member 66. Thus, increase in rotational speed of the governor assembly 65 causes the weight 68 and 69 to swing outwardly by centrifugal force deflecting governor control spring 75 and urge the flange assembly and cup-shaped member 66 leftwardly as shown in FIG. 1. A bearing such as needle bearing 72 is interposed between rotor 21 and the governor assembly 65.

Affixed to the other opposite end of metering rotor 21 is a governor control lever 73 which may be affixed to second portion 13 by a pin 74 and engaging metering rotor 21 at the other opposite end of the lever. A governor control spring 75 may urge lever 73 in a counterclockwise direction as shown in FIG. 1 thus urging metering rotor 21 inwardly of first portion 13. Appropriate thrust bearings 76 which may be in the form of needle bearings allow free rotation of metering rotor 21 in relation to governor control lever 73. It should be apparent to those skilled in the art that other means may be employed to control the axial movement of metering rotor 21. These means could include solonoids, hydraulic pistons or the like. Such means could also replace the governor assembly 65. Furthermore, with the depicted embodiment, governor control lever 73 may be associated with a throttle control linkage (not shown) to provide varying operating conditions.

Metering rotor 21 is formed with an axial bore 80 which communicates with interior cavity 18 of first portion 12. Axial bore 80 is intersected by a plurality of radially extending bores 81 (see FIG. 3). Each radially extending bore 81 communicates with a machined relieved portion 82 which is adjacent to scrolls or lands 82A formed on the periphery of metering rotor 21. As can be seen in FIG. 1, the machined scrolls 82A are formed with one side parallel to the axis of metering rotor 21, a second side perpendicular to the axis and a third side connecting the second side with the first side of the adjacent scroll thus forming generally a truncated triangle when observed in cross section. The purpose of this shape will become apparent in the following discussion. Choice of the aforedescribed speed of rotation of the metering rotor 21 permits the use of four scrolls 82A. Such a combination makes the metering rotor adaptable to all engines having a number of cylinders formed by a multiple of four. This will become apparent in the discussion of an alternate embodiment.

Axially displaced from machined scrolls 82A and in a direction toward the governor lever 73, are a plurality of slots 84 formed in the periphery of rotor 21 each angularly displaced generally 45° from the previously described machined relieved portions 82. Communicating with each slot 84 is a radial bore 85 extending inwardly to intersect an axial bore 86 extending towards the governor control lever 73. Disposed in bore 86 distal of slots 84 is a delivery valve 87 which is resiliently biased to the closed position by resilient means such as helical spring 88. Delivery valve 87 is formed with a conical end 89 adapted to be seated in a similar conical shaped seat in bore 86. Extending outwardly from delivery valve 87 is a radial bore 90 intersecting an elongated slot 91 formed in metering rotor 21. Elongated slot 91 communicates with one of a plurality of ports 96 adapted for connection to a plurality of engine cylinders. For convenience sake one such port means is illustrated in FIG. 1 and includes a bore 92 through sleeve member 24 communicating with a bore 93 in second portion 13 which is plugged by a plug 94 and intersected by a second bore 95 which terminates in an appropriate port 96 in second portion 13. It is to be understood that there will be a number of ports 96 equal to the number of cylinders for which the distributor type fuel injection pump has been formed. As noted, only one such port 96 is shown in this embodiment. Ports 96 are connected by appropriate fuel lines, not shown, with injectors at each engine cylinder.

Figure 2:
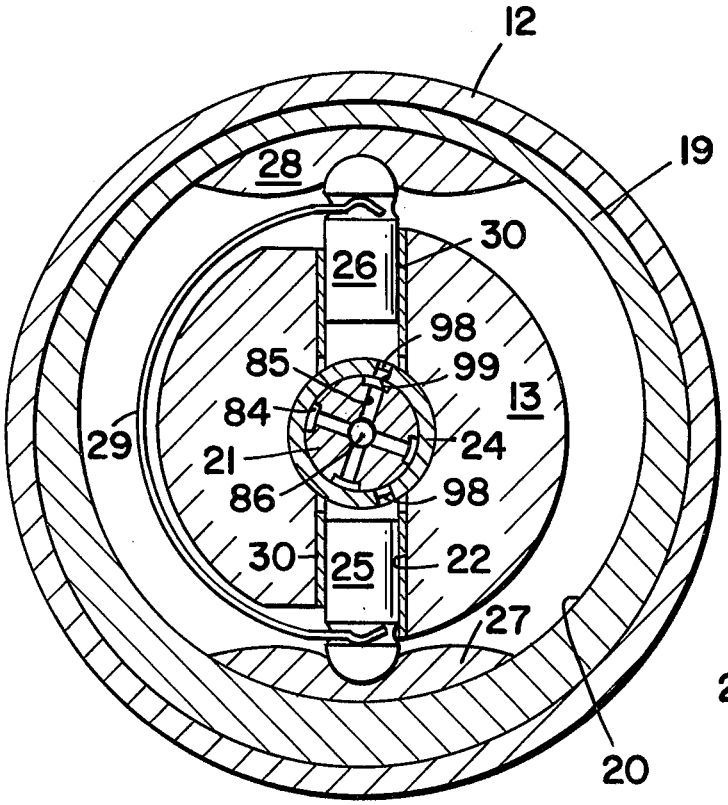
FIG. 2 is a sectional view of a portion of the fuel pump shown in FIG. 1 taken at section line II—II.
Figure 3:
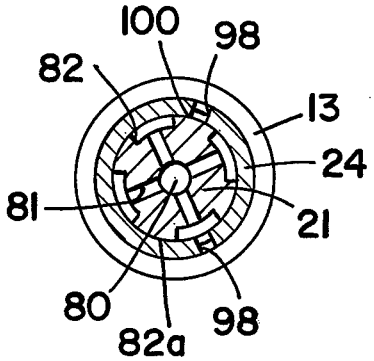
FIG. 3 is a sectional view of the fuel pump illustrated in FIG. 1 taken at section line III—III.

Sleeve member 24 is formed with slots 98 in the vicinity of piston members 25 and 26 and extending rightwardly as shown in FIG. 1 toward governor assembly 65. Reference should be made at this point to FIGS. 2 and 3 to show the angular orientation of the two slots 98 adapted for use in an eight cylinder engine. It is pointed out that the slots 98 just described appear in FIG. 1 to be diametrially opposed. This is for convenience in illustration only and references to FIGS. 2 and 3 show a more representative relationship between the slots. Extending inwardly from slot 98 for communication with slot 84 is a radial bore 99. It should be pointed out at this time that sleeve 24 is fixedly associated with second portion 13 thus the slots 84 will come into and pass out of communication with radial bore 99 as the metering rotor rotates. A second bore 100 extends inwardly from slot 98 in the vicinity of machined relieved portion 82 to communicate with machined relieved portion 82 and to be blocked by scroll 82A. (See FIG. 3).

Several constructional details of the pump which facilitate operation thereof are described hereafter. In view of the fact that interior cavity 18 is pressurized with fluid, the governor members 68 and 69 can create a sufficient amount of disturbance in the fuel chamber to interfere with the operation of piston members 25 and 26. Accordingly, a baffle plate 102 is included within the housing to generally separate the interior cavity 18 and in particular the cavity in which the flyweights 68 and 69 rotate relative the piston members 25 and 26. Further, a bore 104 is formed in the perimeter of cylindrical extension 19 to allow free communication of fluid inwardly and outwardly from this previously described interior cavity containing the flyweights to cavity 18. It should be noted that cylindrical extension 19 is formed with an enlarged extremity in the vicinity of eccentric bore 20. This enlarged extremity forms the bearing surface 105 which in addition to a similar bearing surface formed in bore 46 rotatably supports the first rotating assembly 17.

OPERATION OF THE PREFERRED EMBODIMENT

In operation the distributor type fuel injection pump 10 is driven by shaft 11 interconnected with a prime mover (not shown) for which fuel is to be provided. Fuel is communicated to the integrally formed gear pump 39 of the fuel injection pump wherein it is pressurized for communication to interior cavity 18 and simultaneous communication through the shuttle piston 48 to bore 53 to act on piston 54 and influence timing of the distributor type fuel pump. Planet gear cluster 31 driven by the first rotating assembly 17 in turn drives metering rotor 21. As previously mentioned, shaft 11 which is integrally formed with first rotating assembly 17 may be driven at twice engine speed while the planet gear cluster 31 may reduce the speed of metering rotor 21 to one-half engine speed. Other gear ratios may be appropriate for special configurations. Rotation of the first rotating assembly 17 causes reciprocation of pistons 25 and 26 in their respective bores. Fluid communicated through axial bore 80 flows outwardly through radially extending bores 81 and is periodically communicated to slot 98 as shown in FIG. 3. Fluid communicated to slot 98 is further communicated to piston 25 as shown in FIG. 2. Such fluid, of course, will flow into the cylinder as piston member 25 is urged outwardly against the rotating eccentric bore 20 by C-shaped spring 29. As eccentric bore 20 is urging the other piston 26 inwardly fluid is futher pressurized to be exhausted at a higher pressure through slot 98, radial bore 99 and slot 84 when metering rotor 21 registers with radial bore 99. At this time the same slot 98 is blocked from communication with bore 80 by scroll 82A. The resulting increased pressure in axial bore 86 causes the delivery valve 87 to unseat allowing communication through the valve to elongated slot 91 which communicates with one of the plurality of bores 92 formed in sleeve 24 and hence to passage 93 and 95 to engine cylinders. Fluid is communicated to the cylinder in which piston member 25 is reciprocating as long as machined relieved portion 82 is in communication with the radially extending bore 100 in sleeve 24. Similarly, fluid will be communicated outwardly of the cylinder in which piston 25 or 26 reciprocates as long as slot 84 is in communication with bore 99 and scroll 82A blocks bore 100.

As engine speed increases, flyweight 68 and 69 are urged outwardly thus urging metering rotor 21 leftwardly as shown in FIG. 1. Such axial displacement decreases the time bore 100 is blocked by scroll 82A. This results in less fuel being communicated to the engine cylinders thus decreasing engine speed.

It is well known that as engine speed increases better efficiency is obtained if timing of the injection of fuel is also varied. This is accomplished in this distributor type fuel injection pump by rotation of the ring gear 33 relative to first portion 12 through the use of the tang 59 formed on piston 54. As engine speed increases, the rotation of shaft 11 increases, causing shuttle piston 48 to reciprocate at a higher frequency. Since shuttle piston 48 has a fixed axial travel, the result is a flow through passage 51 which is proportional to speed. The flow passing through passage 51 and passage 63 containing orifice 52 results in pressure proportional to speed, and this pressure communicates through bore 53 to act on piston 54. The increased pressure in bore 53 moves piston 54 leftwardly as indicated in FIG. 6 thus rotating ring gear 33. This rotation of ring gear 33 varies the timing of the entire engine fuel pump 10 directly in proportion to the speed of rotation of the input shaft 11. Other means for rotation of gear 33 may also be employed such as an electronic servo system.

ALTERNATE EMBODIMENTS

Figure 4:
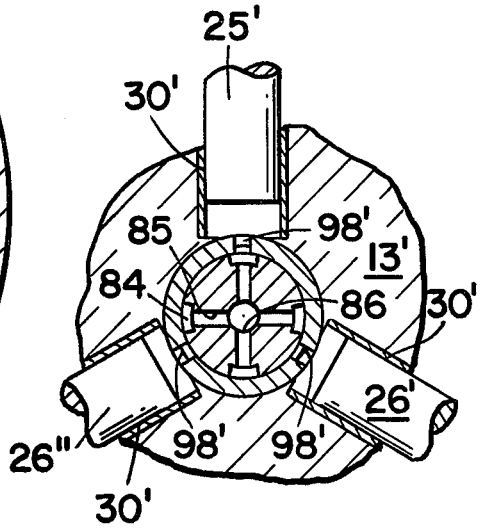
FIG. 4 is an alternate embodiment of the piston arrangement depicted in FIG. 2, particularly adapted for a multi-cylinder engine of 6 or 12 cylinders.
Figure 5:
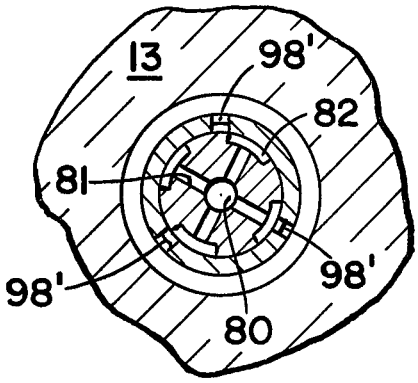
FIG. 5 is a view taken at Section III—III of the embodiment shown in FIG. 4.

Illustrated in FIGS. 4 and 5 is an embodiment particularly configured for use in a 12-cylinder engine. The remaining parts of the engine fuel pump for use with the arrangement shown in FIGS. 4 and 5 are as previously illustrated. It should be noted that FIG. 4 corresponds to FIG. 2, that is, a section taken at line II—II of FIG. 1 while FIG. 5 corresponds to FIG. 3 of the preferred embodiment. It can be seen in FIG. 4 that the number of slots 98' has been increased to three. This relationship is repeated in FIG. 5. Similarly the number of pistons corresponding to piston 25 and 26 has been increased to three.

It should be apparent to those skilled in the art that the embodiment depicted in FIGS. 4 and 5 can be readily adapted to a 6-cylinder 4-stroke engine by eliminating two of the slots 84 and two of the slots 82, ensuring that the remaining slots 84 and slots 82 are each 180° apart.

A 4-cylinder engine may also utilize the same distributor fuel injection pump as described in the preferred embodiment by disabling one of the pistons 25 or 26. This disablement of the piston member may be accomplished by drilling the piston member axially thus allowing fluid trapped in the cylinder to pass outwardly into inner interior cavity 18. Simultaneously the associated port 98 should be plugged.

Finally, it is important to note that pressure necessary to move ring gear 33 to adjust timing and pressures necessary to axially move rotor 21 are minimal as the high pressures are generally confined to the reciprocating piston/slipper arrangement. With such relatively low pressures in the control elements, means other than those described are equally appropriate for axial adjustment or radial adjustment of rotor 21. Accordingly, it is to be understood that this invention is to be considered limited only to the extent of the following claims.

Embodiments of the invention in which an exclusive property or privilege is claimed are defined as follows:

1. A distributor fuel pump assembly for an engine having a plurality of cylinders comprising:

a housing including a generally hollow cylindrical first portion and a second portion affixed to the first portion to form a substantially closed interior cavity, said second portion having a plurality of ports adapted for connection to the plurality of engine cylinders;

a first rotating assembly journalled for rotation in said cavity, said first rotating assembly defining an eccentric inner bore proximate said second portion, said first rotating assembly including an integrally formed shaft means extending outwardly of said cavity distal of said second portion;

a second rotating assembly journalled for rotation in said second portion and extending inwardly of said eccentric bore;

planetary gear means including a ring gear associated with said housing for drivingly connecting said first rotating assembly with said second rotating assembly to cause said second rotating assembly to rotate at a predetermined speed proportional to the speed of rotation of said first rotating assembly;

governor means associated with said second rotating assembly for causing axial movement in said cavity of said second rotating assembly in a first direction away from said first rotating assembly proportional to increased speed of rotation of said second rotating assembly;

means responsive to engine speed for rotating said ring gear relative to said housing;

means for communicating fluid to the interior of said cavity;

radially oriented piston means formed in said second portion, said piston means including a cylinder, a piston mounted for reciprocation in said cylinder and a slipper adapted to engage the eccentric inner bore of the first rotating assembly, said slipper associated with said piston, and resilient means for urging said piston radially outwardly, said piston means for increasing the pressure of said fluid communicated thereto;

first passage means in said second rotating assembly for periodically communicating an amount of pressurized fluid from said cavity to the inner end of the cylinder of said radially oriented piston means;

second passage means also in said second rotating assembly and angularly displaced from said first passage means a predetermined amount for receiving said amount of pressurized fluid at a relatively higher pressure from said piston means and at a rotative position of said shaft determined by the means responsive to engine speed, said second passage means for communicating said amount of higher pressurized fluid to one of the plurality of ports adapted for connection to the plurality of cylinders.

2. The fuel pump assembly as set forth in claim 1 wherein the means for communicating fluid to the interior of the cavity comprises fluid pressurization means for pressurizing fluid communicated to the fuel pump assembly.

3. The fuel pump assembly as set forth in claim 2, wherein the first portion defines a bore, and wherein the shaft means comprises a shaft formed unitarily with the first rotating assembly and extending outwardly through said bore in said first portion, said shaft defining a transverse passage forming a cylinder; and wherein the means responsive to engine speed for rotating the ring gear relative the housing comprises shuttle piston means mounted in said cylinder for transverse reciprocation therein, third passage means communicating pressurized fluid from the fluid pressurization means to the transverse passage, transverse cylinder means defined in said first portion proximate the periphery thereof and radially spaced outwardly from the ring gear, a piston mounted in said transverse cylinder means for reciprocation therein, said piston defining an outwardly extending tang, said ring gear defining a socket for receiving said tang, and orificed passage means extending from said bore opposite the third passage means for communicating fluid periodically from the shuttle piston means to the transverse piston.

4. The distributor fuel pump assembly as set forth in claim 3, wherein the planetary gear means further comprises a plurality of planetary clusters; and a sun gear associated with a second rotating assembly;

said first rotating assembly including a carrier means for mounting said planet gear clusters.

5. The fuel pump assembly as set forth in claim 4 wherein the fluid pressurization means comprises gear pump means disposed in the first portion and driven by the shaft.

6. The fuel pump assembly as set forth in claim 5 wherein the governor means comprises:

a flyweight means associated with the first rotary assembly and responsive to engine speed for the urging of the second rotating assembly in the first direction away from the first rotating assembly; and governor resilient means associated with the second portion for urging the second rotating assembly in a second opposite direction toward the aforesaid first rotating assembly.

7. The fuel pump assembly as set forth in claim 6 further comprising a second radially oriented piston means formed in said second portion, said second piston means including a second cylinder, a second piston mounted for reciprocation in said cylinder and a second slipper adapted to engage the eccentric inner bore of the first rotating assembly, said second slipper associated with said second piston, the resilient means for urging the first piston radially outwardly including means for urging the second piston radially outwardly.

8. The fuel pump assembly set forth in claim 7 wherein the first and second radially oriented piston means are positioned on the extension of a diameter of the second rotating assembly.

9. The fuel pump assembly set forth in claim 8 wherein the first and second rotating assemblies rotate substantially about the same axis.

10. The fuel pump assembly set forth in claim 9 wherein the axis of the eccentric bore is displaced from the axis of rotation of the first and second rotating assemblies.

11. The fuel pump assembly as set forth in claim 6 further comprising a second and third radially oriented piston means formed in said second portion, said second and third piston means including a second cylinder and a third cylinder, a second piston mounted for reciprocation in said second cylinder and a third piston mounted for reciprocation in said third cylinder, and second and third slippers adapted to engage the eccentric inner bore of the first rotating assembly, said second and third slippers associated with said second and third positions.

12. The fuel pump assembly set forth in claim 11 wherein the first, second and third radially oriented piston means are positioned in a plane perpendicular to the axis of the second rotating assembly, and further wherein the cylinders of the first, second and third piston means are oriented substantially 120° apart.

13. The distributor fuel pump assembly set forth in claim 1 wherein the means for communicating pressurized fluid to the interior of the cavity comprises gear pump means disposed in the first portion and driven by the shaft means of the first rotating assembly for pressurizing fluid communicated thereto;

and further wherein the housing defines a first fluid passage for communicating unpressurized fluid to said gear pump and a second fluid passage for communicating pressurized fluid from said gear pump means to the interior cavity of said first portion.

14. The fuel pump assembly set forth in claim 1 further comprising a sleeve journalling the second rotating assembly in the second portion, said sleeve fixed relative said second portion and including slot means extending axially along the outer perimter thereof, first radial passage means for communicating said first passage means with said slot means, second radial passage means for communicating said second passage means with said slot means, said slot means communicating with the cylinder.

* * * * *